US005723422A

United States Patent [19]

O'Dell et al.

[11] Patent Number: 5,723,422

[45] Date of Patent: Mar. 3, 1998

[54] CLEANING PROCESS FOR PHOTORECEPTOR SUBSTRATES

[75] Inventors: Gene W. O'Dell, Williamson; Philip G. Perry, Webster, both of N.Y.

[73] Assignee: Xerox Corporation, Stamford, Conn.

[21] Appl. No.: 656,030

[22] Filed: May 31, 1996

[51] Int. Cl.[6] ..... C11D 1/66

[52] U.S. Cl. ..... 510/166; 510/422; 510/470; 510/475; 510/506; 399/367

[58] Field of Search ..... 510/166, 422, 510/470, 506, 475; 399/357

[56] References Cited

U.S. PATENT DOCUMENTS

| | | | |
|---|---|---|---|
| 4,438,009 | 3/1984 | Brusky et al. | 252/90 |
| 4,530,781 | 7/1985 | Gipp | 252/546 |
| 4,749,516 | 6/1988 | Brusky et al. | 252/546 |
| 5,346,556 | 9/1994 | Perry . | |
| 5,374,369 | 12/1994 | Angevaare et al. | 252/102 |
| 5,415,813 | 5/1995 | Misselyn et al. | 252/547 |
| 5,468,410 | 11/1995 | Angevaare et al. | 252/95 |
| 5,480,576 | 1/1996 | Gary et al. | 252/95 |
| 5,489,531 | 2/1996 | Benson | 435/264 |
| 5,552,089 | 9/1996 | Misselyn et al. | 510/417 |
| 5,624,892 | 4/1997 | Angevaare et al. | 510/223 |

*Primary Examiner*—Douglas J. McGinty
*Assistant Examiner*—John R. Hardee
*Attorney, Agent, or Firm*—Oliff & Berridge, PLC

[57] ABSTRACT

A cleaning solution for cleaning substrates such as imaging member substrates includes a weak acid, borax or a polyphosphate, an oil-soluble surfactant, and a water-soluble surfactant such as a water-soluble polysorbate, a polyethylene/polypropylene copolymer or a mixture thereof. The cleaning solution increases the cleaning capability of a corresponding cleaning process, and also improves the efficiency of the cleaning process by avoiding the necessity of neutralization and waste treatment operations.

19 Claims, No Drawings

CLEANING PROCESS FOR PHOTORECEPTOR SUBSTRATES

BACKGROUND OF THE INVENTION

This invention relates to methods for cleaning surfaces. More particularly, this invention relates to an improved cleaning solution and a process using that solution for cleaning photoreceptor substrate surfaces.

Many electrophotographic copiers, digital copiers, laser printers, and the like contain an electrophotographic photoreceptor wherein a photoconductive layer is provided on a rotatable drum-like or belt-like substrate. The substrate may be made by machining the surface of a pipe, during which process a cutting fluid is normally used. The cutting fluid is used to cool, lubricate, and clean the substrate. Many current processes for machining photoreceptor substrates use a petroleum-based cutting fluid. Still other processes exist, however, that use synthetic or water-based machining fluids. In all of these processes, it is generally necessary to remove residual machining fluid from the substrate prior to subsequent processing, especially where the machining fluid includes oil-based (or petroleum-based) components or contaminants.

For inspection purposes and to prepare the substrates for final cleaning and coating of other photoconductor layers, the substrates are cleaned after being machined to remove residual cutting fluid, debris, dust, and the like. Numerous methods are known in the art for cleaning such substrate surfaces, and various cleaning solutions for such processes are also known. Typically, petroleum residues, such as from the cutting fluid, on the surface of a photoreceptor substrate are removed by methods using an ultrasonic vapor degreaser with a chlorine solvent. For example, 1,1,1-trichloroethane, trichloroethylene, perchloroethylene, methylene chloride, and the like are widely used in such cleaning processes. However, the use of such solvents can cause problems of environmental contamination and working safety from the viewpoint of ozone layer destruction, carcinogenicity and the like. Furthermore, the waste solvents must be treated for appropriate waste treatment prior to being discharged into the environment, thereby adding additional cost and processing requirements to the cleaning process.

Another problem with such chlorine-containing cleaning solutions is that such solutions, and particularly those containing chlorofluorocarbons, may leave spots on the clean substrate surface. These spots can change the electrophotographic development properties of the subsequently applied layers, and thus of the final imaging member. For example, the imaging surface of the imaging member may not discharge or may discharge poorly in the areas corresponding to the spots. This can be seen as darker or lighter areas in the final printed copy, depending on whether discharged areas or charged areas development is used.

Furthermore, some contaminants may not be readily and easily removed from the substrate surface by such cleaning solutions. The result can be resist spots on the substrate surface. Imaging members formed from such spotted substrates are rejected because of poor quality, which in turn results in a reduction in the fabrication rate.

Alternatives to chlorine-containing solvents are known, and include aliphatic hydrocarbons such as kerosene and strong acid or strong alkaline-based detergents. However, these alternatives can present new problems including fire risks and requiring further waste neutralization processing. Moreover, such acidic and alkaline cleaning solutions further increase the waste treatment steps of the cleaning process because they must be neutralized prior to discharge into the environment.

SUMMARY OF THE INVENTION

The present invention provides a cleaning solution for cleaning imaging member substrates, comprising:

(a) a weak acid, (b) at least one compound selected from the group consisting of borax and polyphosphates, (c) an oil-soluble surfactant, and (d) a water-soluble surfactant selected from the group consisting of a water-soluble polysorbate, a polyethylene/polypropylene copolymer, and mixtures thereof.

The present invention thus provides a cleaning solution, and cleaning method using that solution, that not only increases the cleaning capability of the solution, but also improves the efficiency of the cleaning process by avoiding the necessity of neutralization and waste treatment operations.

DETAILED DESCRIPTION OF PREFERRED EMBODIMENTS

The cleaning solutions of the present invention generally comprise a weak acid, borax or similar material, an oil-soluble ethoxylated alcohol surfactant, and a compatible water-soluble polysorbate.

In embodiments of the present invention, any suitable weak acid may be incorporated into the cleaning solution, provided that the acid satisfies the goals of the present invention by cleaning the substrate surface without reacting with the substrate surface or other components of the cleaning solution. That is, the acid in the cleaning solution is preferably an acid that is mild enough not to attack metal oxide on the surface of the substrate, and which has chelating or sequestering properties that allow it to chelate or sequester heavy metals. Examples of suitable acids include organic acids and mineral acids.

Examples of suitable organic acids include, but are not limited to, carboxylic acids, dicarboxylic acids, hydroxy acids, acids containing both hydroxy and carboxylic groups, acids containing both hydroxy and amino groups, mixtures thereof and the like. Examples of specific suitable organic acids include, but are not limited to, citric acid, glutamic acid, lactic acid, tartaric acid, oxalic acid, boric acid, acetic acid, mixtures thereof and the like.

Suitable mineral acids include, but are not limited to, nitric acid, phosphoric acid, sulfuric acid, mixtures thereof and the like. When such mineral acids are used in cleaning solutions of the present invention, it is preferred that the acid be in a dilute form. For example, the acid strength of the dilute strong acids should range from about 0.05% to about 1.5% by weight, and more preferably should be from about 0.1% to about 0.3% by weight.

In embodiments, the most preferred acid for use in the cleaning solution is citric acid.

The cleaning solutions of the present invention also generally contain an effective amount of borax or a similar material. The borax or similar material is included for its buffering, detergent binding and sequestering properties. Alternative materials that may be used in the present invention in place of or in addition to borax include, but are not limited to, polyphosphates such as trisodium polyphosphate and tetrasodium pyrophosphate, and the like. However, borax is preferred in embodiments because it is more environmentally friendly.

Preferably, in embodiments of the present invention, the weak acid and borax are contained in the cleaning solutions in a sufficient amount and an appropriate concentration to provide their respective purposes. For example, the total concentration of the combined weak acid and borax is preferably maintained at a level of less than about 2.0% by weight, more preferably from about 0.1% to 1.0% by weight, and most preferably from about 0.3% to about 0.4% by weight.

Furthermore, the weak acid and borax (or similar material) are contained in the cleaning solutions of the present invention in a sufficient ratio to provide a pH of from about 5.5 to about 8. Preferably, the pH of the final cleaning solution is from about 6.2 to about 7.8, and more preferably is from about 6.5 to about 7.5. As will be apparent to those skilled in the art, the ratio of the specific weak acid and borax will depend upon such factors as the relative strength of the materials and the desired final pH to be achieved. However, in embodiments of the present invention, it is preferred that the ratio of weak acid to borax is from about 1 to about 3.

The cleaning solutions of the present invention further comprise a suitable surfactant. Suitable surfactants for cleaning solutions of the present invention include any of the various known surfactants, and preferably those that are oil-soluble. Preferably, the surfactant is a nonionic surfactant. The surfactant is preferably not anionic or cationic because anionic or cationic surfactants, if insufficiently removed, may cause poor electrostatic development performance. Additionally, some anionic or cationic surfactants may cause etching of the substrate surface, such as aluminum surfaces. The surfactant for use in the cleaning solutions of the present invention also preferably has a low foaming nature to facilitate rinsing. Preferably, the surfactant has a hydrophilic/lipophilic balance (HLB) value in the range of from about 10 to about 20.

Examples of suitable non-ionic surfactants include, but are not limited to, copolymers of propylene oxide and ethylene oxide, ethoxylated alcohols, ethoxylated alkyl phenols, ethoxylated sorbitol esters, mixtures thereof and the like. Preferably, when ethoxylated alcohols or ethoxylated alkyl phenols are used in the cleaning solution, the surfactant is a ($C_8$–$C_{15}$ linear primary alcohol ethoxylate or $C_8$–$C_{15}$ linear alkyl phenol ethoxylate, respectively. Where ethoxylated alcohol and ethoxylated alkyl phenol surfactants are used, it is also preferred in embodiments that the surfactant have a lower HLB ratio for better oil solubilizing capability. Most preferably, the surfactant used in the cleaning solutions of the present invention is Igepal CO-530 (nonylphenoxy polyethoxy ethanol), Triton X-114 (octylphenoxy polyethoxy ethanol), Pluronic L-35 (propylene oxide/ethylene oxide copolymer) or Hodag PSML-20 (polyoxyethylene sorbitan monolaurate).

Preferably, the surfactants are included in the cleaning solution of the present invention in an amount ranging from about 0.01 to about 10.0 grams per liter of the cleaning solution. More preferably, the surfactant is included in the cleaning solution in an amount of from about 0.1 to about 1.0 grams per liter.

The cleaning solutions of the present invention include a water-soluble polysorbate to aid in dissolving components of synthetic machining fluids and an alkyl phenol ethoxylate to aid in dissolving oils and greases, and particularly silicone-based oils. Suitable polysorbates for use in embodiments of the present invention include, but are not limited to, polyoxyethylene sorbitan monolaurate, polyoxyethylene sorbitan monostearate, polyoxyethylene sorbitan monooleate, polyethylene sorbitan tristearate, mixtures thereof and the like. Most preferably, the cleaning solutions of the present invention include the polyoxyethylene sorbitan monolaurate. In embodiments of the present invention, it is preferred that the polysorbate be contained in the cleaning solution in an effective amount, and preferably from about 0.01% to about 0.1% by weight, more preferably from about 0.02% to about 0.05% by weight.

Preferably, in embodiments, the cleaning solutions of the present invention include a water-soluble polysorbate with an HLB ratio of about 17 and an ethoxylated alkyl phenol, having an HLB ratio of about 10.5. Suitable ethoxylated alkyl phenols for use in embodiments of the present invention include, but are not limited to, nonylphenol ethoxylate, octylphenol ethoxylate, dinonylphenol ethoxylate, dodecylphenol ethoxylate, mixtures thereof, and the like. In embodiments, the cleaning solution of the present invention preferably includes nonylphenol ethoxylate.

In the cleaning solutions of the present invention, the water-soluble polysorbate should be compatible with the ethoxylated alkyl phenol.

The balance of the cleaning solution of the present invention typically is water. Preferably, the water used in forming the cleaning solution of the present invention is deionized water, which refers to water that has been demineralized by removal of inorganic constituents. Preferably, the deionized water has a resistivity of at least 1 M ohm-cm, and preferably a resistivity of from about 2 to about 20 M ohm-cm.

The cleaning solutions of the present invention may also optionally include known additives for their known purposes. For example, the cleaning solution may include such additives as to lower foaming tendencies, provide metal chelation capability, corrosion protection, etc. For example, the polyethylene/polypropylene copolymer surfactant Pluronic L-35 may be substituted in whole or in part for the polysorbate in order to reduce the cleaner's foaming tendencies. EDTA edetates may be included in the formulation for metal chelation or antioxidative capability.

Substantially any type of substrate surface can be cleaned using the cleaning solution and methods of the present invention. Examples of suitable substrates that can be cleaned by the cleaning solutions and methods of the present invention include, but are not limited to, metal such as aluminum, nickel, stainless steel, chromium, magnesium, titanium and zinc alloys such as brass; engineering plastics such as nylons, polycarbonates, polyimides, polysulfones, and fluoropolymers; and the like. Preferably, the cleaning solution and methods of the present invention are used to clean surfaces of imaging member substrates for use in ionographic or electrophotographic processes.

More preferably, the cleaning solutions and methods of the present invention are used to clean photoreceptor substrate surfaces. Such substrates may have any suitable shape. Typical shapes include hollow cylindrical drums or pipes, sheets, belts, plates, disks, and the like.

The cleaning solutions and methods of the present invention may be used to remove the various undesirable contaminants that typically exist during the photoreceptor production process. For example, such contaminants include dirts and oils, for example, such as those arising from the manufacturing process and environmental handling.

The cleaning solutions of the present invention may be used in any of the various cleaning processes known in the art and evident from the present disclosure. Preferably, the substrate to be cleaned is contacted with the cleaning solution by any suitable technique. For example, the substrate may be contacted with the cleaning solution by spraying, dipping, flowing, cascading, and the like in cleaning solution over the substrate. Preferably, however, the substrate surface is immersed into a bath of the cleaning solution.

Where the substrate is immersed into a bath of the cleaning solution, the cleaning solution is preferably agitated during contact with the substrate. For example, ultrasonic energy may be applied to the bath to assist in cleaning the substrate. Where ultrasonic energy is applied to the bath, it may be applied by any suitable technique, for example, by securing an ultrasonic transducer to the bath housing and activating the transducer. Suitable ultrasonic frequencies range from about 25 to about 55 KHz and preferably from 38 to about 42 KHz. Cleaning efficiency can be further enhanced by heating the cleaning solution. Preferably, the cleaning solution is maintained at a temperature of from about 25° C. to about 55° C., more preferably from about 35° C. to about 50° C., and most preferably from about 40° C. to about 45° C. Cleaning immersion times will vary depending upon the levels of soils to be removed from the parts. For removing water-soluble machining fluids, for example, immersion times of from about 30 sec to about 90 sec should be adequate. However, removal of oil-based materials, for example, will likely require longer immersion times, on the order of about 2 min to about 5 min. If highly polished surfaces require longer immersion times and use of ultrasonic agitation is desired, it may be necessary to oscillate the parts during the immersion cleaning process to prevent ultrasonic damage (burning) to the surfaces.

If spray cleaning is preferred over immersion cleaning, it may be necessary to incorporate a surfactant with lower foaming tendencies into the cleaning solution. For such embodiments, a low foaming polyethylene/polypropylene copolymer such as Pluronic L-35 can be substituted for the higher foaming polysorbate material with little loss in cleaning efficiency. Suitable cleaning spray pressures range from about 5 psi to about 25 psi, with a more preferred range being from about 10 psi to about 15 psi.

Following cleaning of the substrate with the cleaning solution, the substrate surface is typically rinsed in deionized water to remove excess cleaning solution. Although any suitable rinsing technique may be used, for example, spraying, dipping, flowing, cascading and the like, the preferred rinsing technique is immersion of the substrate into a bath of deionized water because immersion involves lower costs than other rinsing techniques. Preferably, the deionized water rinse is maintained at a temperature of from about 25° C. to about 50° C., more preferably from about 30° C. to about 45° C., and most preferably from about 35° C. to about 40° C.

In embodiments, multiple rinse steps may be used following the cleaning step. In a preferred embodiment, the above-described rinse step is followed by a second rinse step using deionized water. Preferably, the second rinse step uses deionized water having a resistivity of from about 5 M ohm-cm to about 18 M ohm-cm, and at a temperature of about 70° C. Immersion times in the second rinse step should generally be similar to the rinse time of the first rinse step, and preferably is about 60 sec. If immersion time in the second rinse step is much greater than a couple minutes, visible signs of etching may become apparent on mirror lathed substrates such as mirror lathed aluminum substrates. Such an effect is detrimental for mirror lathed substrates, but may be desired for rough lathed substrates, for example for further enhancing plywood suppression.

The substrate surface may undergo additional cleaning and rinsing operations depending upon tenacity of the contaminants and whether additional cleanliness is required. The substrate surface may thereafter be dried and/or cooled, as necessary.

After the substrate surface is cleaned, it may be coated with any suitable coatings to fabricate an electrostatographic imaging member according to processes and procedures known in the art.

To form electrostatographic imaging members, the clean substrate surface may be coated with a blocking layer, a charge generating layer, and a charge transport layer. Optional adhesive undercoating, overcoating and anti-curl layers may also be included. Alternatively, a single photoconductive layer may be applied to the substrate. If desired, the sequence of the application of coatings of multilayered photoreceptors can be varied. Thus, a charge transport layer may be applied prior to the charge generating layer, or a charge generating layer may be applied prior to the charge transport layer. The photoconductive coating may be homogeneous and contain particles dispersed in film-forming binder. The homogeneous photoconductive layer may be organic or inorganic. The dispersed particles may be organic or inorganic photoconductive particles. Thus, for the manufacture of electrostatographic imaging members, at least one photoconductive is applied to the clean substrate. To form ionographic imaging members, the etched substrate may be coated with an electrically conductive layer, a dielectric imaging layer, and an overcoating layer.

The invention will now be described in detail with reference to specific preferred embodiments thereof. All parts and percentages are by weight unless otherwise indicated.

EXAMPLES

Example 1

A cleaning solution is prepared by mixing the following components: 3.04 wt % citric acid (anhydrous), 8.69 wt % borax, 0.68 wt % Hodag PSML-20 (polyoxyethylene sorbitan monolaurate), 0.72 wt % Igepal CO-530 (nonylphenoxy polyethoxy ethanol) and 86.87 wt % deionized water. In this example, the deionized water has a conductivity of ≦1 microSiemen/cm.

In particular, the cleaning solution is prepared by adding 40 gallons of deionized water to a clean 55 gallon polyethylene drum. While stirring, 13.13 lbs of citric acid is slowly added to the deionized water, and is stirred until fully dissolved. 37.5 lbs of borax are then added to the solution, with stirring, until fully dissolved. 1,277.4 ml of Igepal CO-530 is added to the solution, without stirring (to avoid foaming), followed by slow stirring for ten to fifteen minutes. Similarly, 1,277.4 ml of Hodag PSML-20 is added to the solution, without stirring, followed by slowly stirring the solution for ten to fifteen minutes. In the addition of both the Igepal CO-530 and Hodag PSML-20, the graduated cylinders used to measure the materials are flushed with 2.5 gallons of deionized water, which is added to the solution in the drum, to ensure complete removal of the materials.

The thus-prepared cleaning solution has a pH of between 5.75 and 6.25, and a conductivity (of a 3.2% by volume solution) of between 1,000 and 1,500 Siemens/cm.

Example 2

The cleaning solution concentrate prepared in Example 1 is used to clean the surface of pipe-shaped imaging member substrates by diluting to 3–10% with deionized water having a resistivity of ≧1 M ohm-cm. Following a series of surfactant/brush washings and distilled water rinsing operations, the pipes to be cleaned are lowered into a bath containing the cleaner of Example 1, for an immersion time of 60 seconds. The cleaning bath contains 3.2% by volume of the cleaning solution concentrate, maintained at a temperature of 45° C.±2° C. Ultrasonic power of 3.250 watts at 40 KHz is automatically activated. The ultrasonic power is applied for 10 seconds in the case of mirror-lathed substrates or 40 seconds for rough-lathed substrates.

After completion of the immersion cleaning step, the substrate is removed from the cleaning station and is moved to a first rinse station. In the first rinse station, the substrate is lowered into a rinse tank of deionized water having a resistivity of ≧1.0 M ohm-cm. The substrate is emersed in the deionized water for a period of 60 seconds, maintained at ambient temperature. As in the cleaning step, ultrasonic power at 3.250 watts and 40 KHz may optionally be applied to the rinse solution for a period of up to 40 seconds. Following completion of the rinse operation, the substrate is removed from the solution and is moved to a second rinse step.

The second rinse operation uses deionized water maintained at a temperature of 70° C.±2° C. The deionized water has a resistivity of ≧1.0 M ohm-cm. The substrate is immersed in the rinse bath for 60 seconds, after which it is slowly withdrawn from the solution at a rate of about 1 inch per second to minimize residual droplets on the substrate. The substrate is then dried and cooled.

This cleaning process, using the neutral cleaning solution of Example 1, provides an extremely clean substrate surface while avoiding the necessity of neutralization and waste treatment operations of the effluent cleaning solution.

What is claimed is:

1. A cleaning solution for cleaning imaging member substrates, comprising:

(a) an acid selected from the group consisting of a weak acid and a dilute strong acid, (b) at least one compound selected from the group consisting of borax and polyphosphates, (c) an oil-soluble surfactant, (d) a water-soluble surfactant selected from the group consisting of a water-soluble polysorbate, a polyethylene/polypropylene copolymer, and mixtures thereof, and (e) deionized water, wherein a total concentration of said component (a) and said component (b) is less than about 1% by weight of the cleaning solution.

2. The cleaning solution of claim 1, wherein said component (b) comprises borax and said component (d) comprises water-soluble polysorbate.

3. The cleaning solution of claim 1, wherein said component (a) is an organic acid.

4. The cleaning solution of claim 3, wherein said component (a) is an organic acid selected from the group consisting of citric acid, glutamic acid, lactic acid, tartaric acid, oxalic acid, boric acid, acetic acid, and mixtures thereof.

5. The cleaning solution of claim 3, wherein said component (a) is citric acid.

6. The cleaning solution of claim 1, wherein a total concentration of said component (a) and said component (b) is between 0.3% and 0.4% by weight of the cleaning solution.

7. The cleaning solution of claim 1, wherein said cleaning solution has a pH of from about 6 to about 8.

8. The cleaning solution of claim 1, wherein a ratio of said component (a) to said component (b) is from about 1 to about 3.

9. The cleaning solution of claim 1, wherein said oil-soluble surfactant has a hydrophilic/lipophilic balance value in the range of from about 10 to about 20.

10. The cleaning solution of claim 1, wherein said oil-soluble surfactant is a non-ionic surfactant.

11. The cleaning solution of claim 10, wherein said non-ionic surfactant is selected from the group consisting of $C_8$–$C_{15}$ linear primary alcohol ethoxylates, $C_8$–$C_{15}$ linear alkyl phenol ethoxylates, ethylene oxide/propylene oxide block copolymers, ethoxylated sorbitol esters, and mixtures thereof.

12. The cleaning solution of claim 1, wherein said oil-soluble surfactant is included in the cleaning solution in an amount of from about 0.01 to about 10.0 grams per liter of the cleaning solution.

13. The cleaning solution of claim 2, wherein said water-soluble polysorbate is selected from the group consisting of polyoxyethylene sorbitan monolaurate, polyoxyethylene sorbitan monostearate, polyoxyethylene sorbitan monooleate, polyethylene sorbitan tristearate, and mixtures thereof.

14. The cleaning solution of claim 1, wherein said component (d) is included in the cleaning solution in an amount of from about 0.01 to about 0.1% by weight of the cleaning solution.

15. The cleaning solution of claim 1, wherein said deionized water has a resistivity of at least 1 M ohm-cm.

16. The cleaning solution of claim 1, wherein said cleaning solution is suitable for cleaning imaging member substrate surfaces.

17. A process for cleaning substrate surfaces, comprising:

providing a substrate surface to be cleaned, contacting said surface with the cleaning solution of claim 1, and cleaning said surface with said cleaning solution.

18. The process of claim 17, wherein said surface is contact with said cleaning solution by immersing said surface into a bath of said cleaning solution.

19. The process of claim 17, further comprising removing said surface from contact with said cleaning solution, and drying said surface.

* * * * *